US005899345A

United States Patent [19]

Fuller et al.

[11] Patent Number: 5,899,345

[45] Date of Patent: May 4, 1999

[54] MIXABLE PRODUCT DISPLAY STAND

[76] Inventors: Stephen M. Fuller, 1241 Thomas La., Hixson, Tenn. 37343; Stuart B. Bickley, 202 W. Watkins, Lookout Mountain, Tenn. 37350; Casey E. Coleman, Jr., 2909 Dublin Dr., Helena, Ala. 35070; Jerry N. Cunningham, 609 S. Palisades, Signal Mountain, Tenn. 37377

[21] Appl. No.: 08/808,252

[22] Filed: Feb. 28, 1997

[51] Int. Cl.[6] ..... A47F 5/00

[52] U.S. Cl. ..... 211/132.1; 211/126.16; 211/149; 248/174

[58] Field of Search ..... 211/132.1, 149, 211/126.16, 72, 135, 186; 248/174

[56] References Cited

U.S. PATENT DOCUMENTS

| | | | |
|---|---|---|---|
| Re. 32,443 | 6/1987 | Kalal | 206/45.31 |
| 3,549,019 | 12/1970 | Wood et al. | 211/135 |
| 3,774,774 | 11/1973 | Menkel | 211/72 |
| 3,999,662 | 12/1976 | Barnhardt | 211/126.16 |
| 4,151,803 | 5/1979 | Ferrera et al. | 211/135 X |
| 4,228,904 | 10/1980 | Dumond | 211/55 |
| 4,410,129 | 10/1983 | Wischusen, III | 229/41 |
| 4,454,946 | 6/1984 | Yokowo | 206/600 |
| 4,456,122 | 6/1984 | Kalal | 206/45.34 |
| 4,506,790 | 3/1985 | Muscari | 211/135 X |
| 4,519,319 | 5/1985 | Howlett | 248/174 X |
| 4,523,675 | 6/1985 | Schroter | 206/44 |
| 4,530,548 | 7/1985 | Spamer et al. | 211/72 X |
| 4,605,130 | 8/1986 | Taub | 211/72 X |
| 4,697,699 | 10/1987 | Schneider | 206/44.11 |
| 4,705,162 | 11/1987 | Kupersmit | 206/45.11 |
| 4,715,493 | 12/1987 | Dreyfus | 206/200 |
| 4,718,545 | 1/1988 | Chrzanowski et al. | 206/45.15 |
| 4,809,847 | 3/1989 | Schneider | 206/45.31 |
| 4,907,693 | 3/1990 | Child | 206/44 |
| 5,249,669 | 10/1993 | Resnick et al. | 206/45.15 |
| 5,293,991 | 3/1994 | Neumann et al. | 206/45.12 |
| 5,392,902 | 2/1995 | Vlastakis | 206/45 |
| 5,392,985 | 2/1995 | Smith et al. | 229/125 |
| 5,465,831 | 11/1995 | Smith | 206/44 |
| 5,564,578 | 10/1996 | Smith | 248/174 X |

*Primary Examiner*—Robert W. Gibson, Jr.
*Attorney, Agent, or Firm*—Miller & Martin LLP

[57] ABSTRACT

A multiple product display stand is disclosed which is free-standing and generally rectangular in shape with a rearwardly inclined open front to more openly display the products to the consumer. The display stand has a means for presenting additional packaging to consumers so that they will be able to select and package a desired selection of the products being displayed upon one or more vertically spaced, rearwardly inclined shelves.

15 Claims, 5 Drawing Sheets

FIG. 2
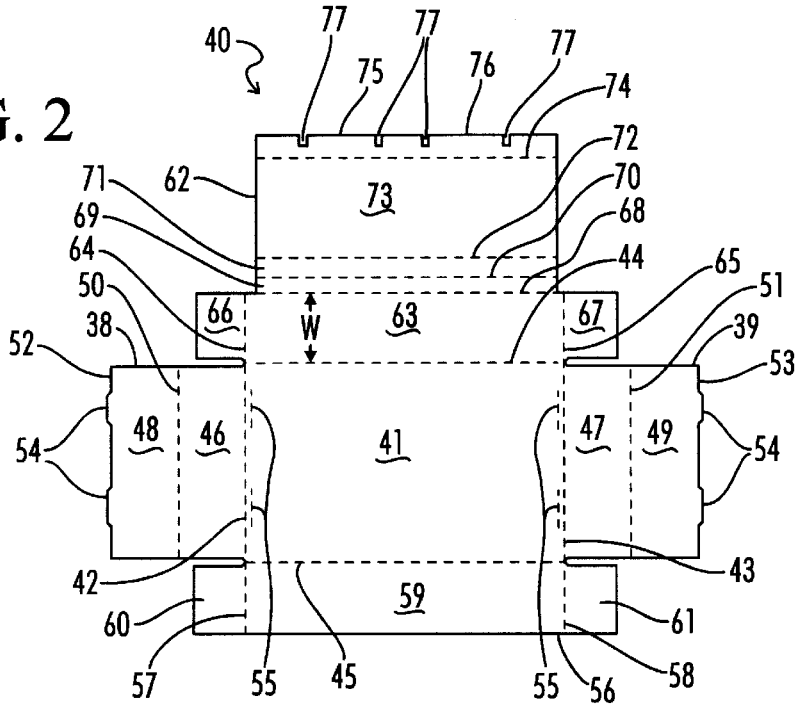
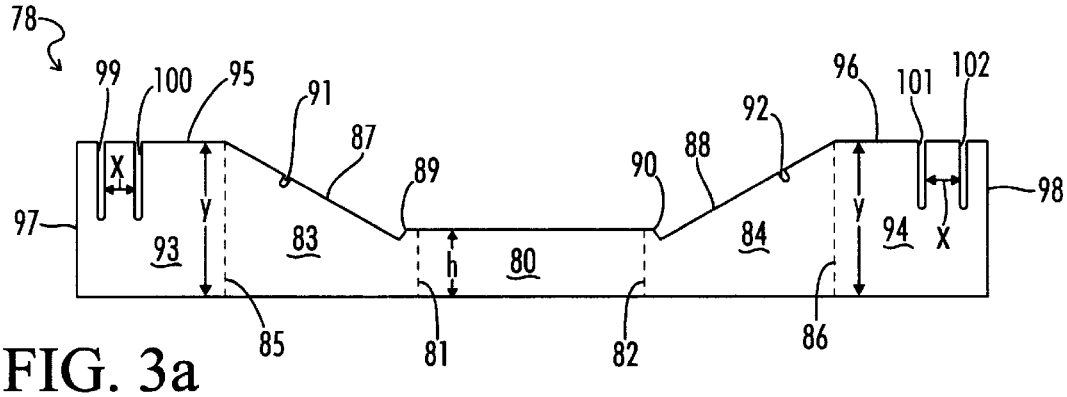
FIG. 3a
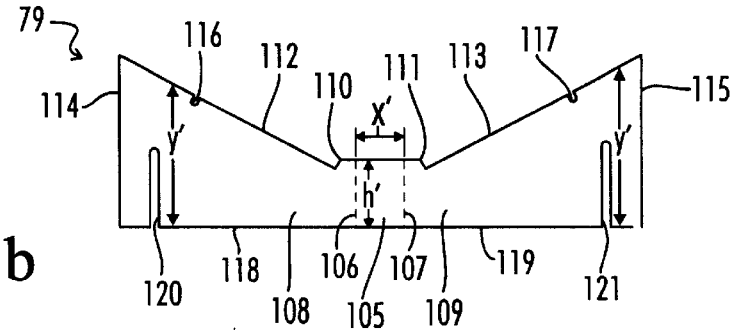
FIG. 3b

How does this look?

MIXABLE PRODUCT DISPLAY STAND

BACKGROUND OF THE INVENTION

The present invention relates to display stands formed primarily from foldable sheet material such as paperboard or corrugated board to hold and to display packages of merchandise.

Display stands formed from foldable sheet material such as paperboard or corrugated board are well known for use in the display of merchandise items for sale in retail outlets. Such stands are quite versatile in that they can be designed to accommodate the needs of a particular product. Also these display stands are relatively inexpensive so that they can be discarded or recycled after they have served their purpose for the display and promotion of the selected product or merchandise.

A number of display stands have been disclosed which include vertically spaced shelves mounted on opposing side wall supports. While such stands have been effective for displaying the products for which they were designed, they do not provide a suitable vehicle for all products, particularly those requiring added structural strength for supporting the packages of product on display, or those the manufacturer or retailer desires to market in a unique or unusual fashion.

SUMMARY OF THE INVENTION

The present invention is a display stand having a unique combination of features that are especially suited to the simultaneous display of multiple types of relatively heavy products. In the present invention, the displayed products are preferably in the form of individually packaged candies as well as in the form of packages or boxes containing a number of individually packaged candies. The invention also includes a means for presenting additional packaging to consumers so that the consumers may select and package for themselves a desired selection of the individually packaged candies. The invention also includes a means for supporting graphic display materials concerning the products on display.

It is, therefore, a principal object of the present invention to provide a merchandise display stand having a plurality of vertically spaced, inclined shelves which promote the gravity feed of product packages to the front edges of the shelves for easy removal from the shelves.

It is a further object of the present invention to provide a display stand having sufficient strength in its components to provide support for the weight of the products being displayed.

It is also an object of the present invention to provide a means for presenting additional packaging to a consumer so that the consumer may select and package for himself or herself a desired selection of the products being displayed.

It is a further object of the present invention to provide a means for supporting graphic display materials concerning the products on display.

Another object of the present invention is to provide blanks for each of the components of the display stand which can be partially assembled prior to shipment of the stand to facilitate final assembly of the display stand at a site where it is to be used.

Another object of the present invention is to provide a display stand which may be formed from partially assembled blanks and may be conveniently shipped in a relatively flat package to the point of final assembly and use.

These and other objects, advantages and applications of the present invention will become apparent to those skilled in the art when the accompanying description of the preferred embodiment of the present invention is read in conjunction with the accompanying drawings.

BRIEF DESCRIPTION OF THE DRAWINGS

FIG. 2 is a plan view of a base blank of foldable sheet material from which a base of the display stand may be formed.

FIG. 3*a* is a plan view of an outer support blank of foldable sheet material from which a lower support of the display stand may be formed.

FIG. 3*b* is a plan view of an inner support blank of foldable sheet material from which a lower support of the display stand may be formed.

DETAILED DESCRIPTION OF THE DRAWINGS

Figure 1:
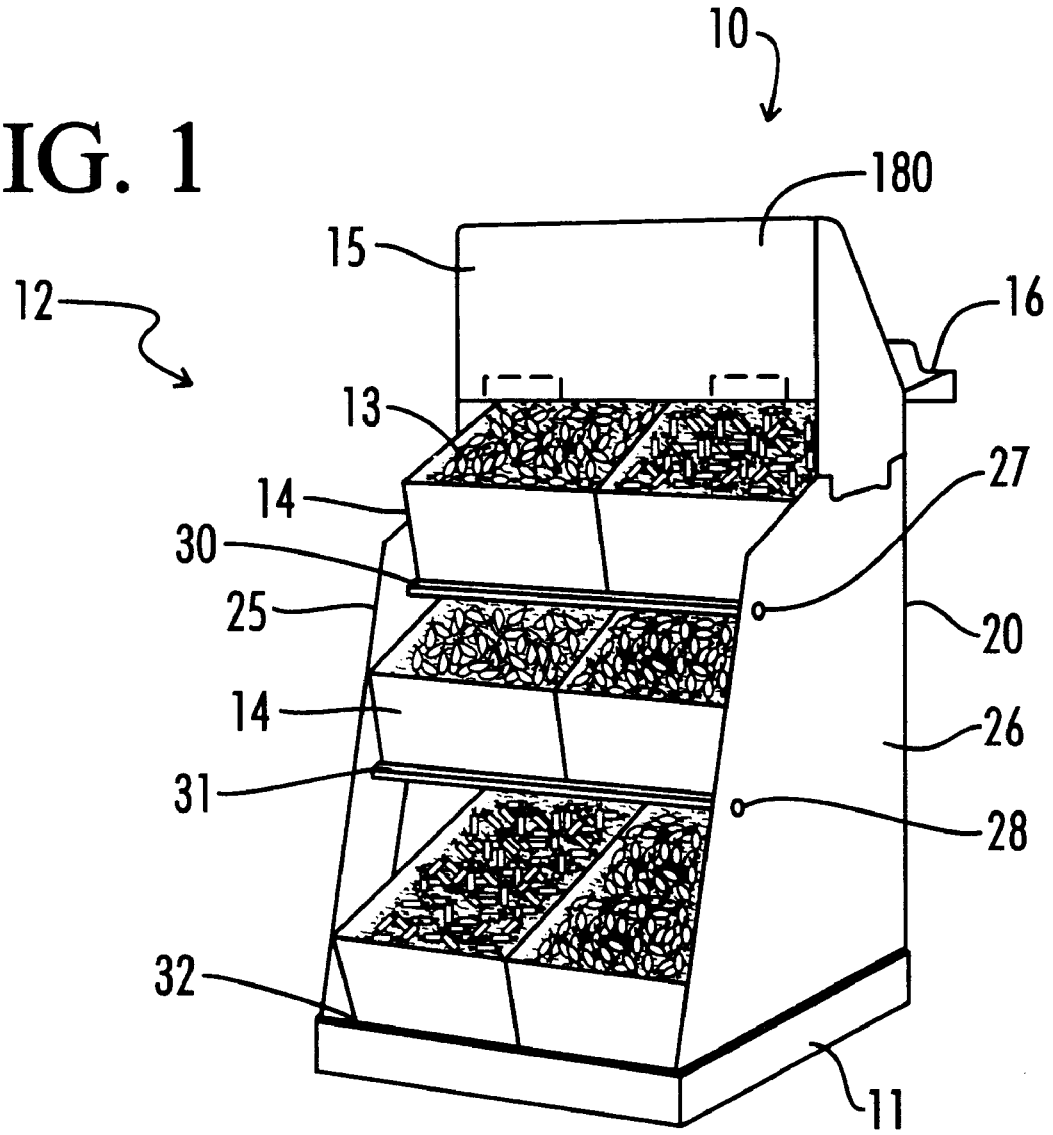
FIG. 1 is a perspective view of a preferred embodiment of the display stand of the present invention.

Referring now to the drawings and in particular to FIG. 1, a preferred embodiment of the display stand 10 of the present invention is shown. The display stand 10 is free-standing and generally rectangular in shape, though the open front side 12 is inclined rearward from bottom to top so that the products 13 being displayed are more openly presented to the consumer. The display stand 10 comprises a base 11, a central, vertically disposed rear wall 20 having a pair of opposing side wall assemblies 25 and 26, a lower support 29 (not shown in FIG. 1), a plurality of support elements 27 and 28, a plurality of vertically spaced, rearwardly inclined shelves 30, 31 and 32, a plurality of individual boxes 14, a means for supporting graphic display materials such as header device 15, and a means for presenting additional packaging to consumers such as rearwardly disposed container shelf 16. All components of the display stand 10 except for support elements 27 and 28 are constructed from a foldable sheet material (preferably corrugate d board).

As shown in FIGS. 2 through 7, the display stand 10 is formed from a plurality of blanks 40, 78, 79, 155, 173 and 178, portions of which may be pre-assembled at the point of manufacture prior to shipping to the point of use. Such pre-assembly facilitates the final assembly of the display stand 10 by the ultimate retail user at the point of use. However, even with portions pre-assembled, the components of the present invention are designed such that they may be shipped in a relatively flat, compact package to the point of use. The ability of the components of the display stand to be packed in this convenient shipping size reduces the cost of shipment of the display stand 10 to the ultimate point of assembly and use because the unassembled components occupy significantly less space than the assembled display stand 10.

Blanks 40, 78, 79, 155, 173 and 178 are scored through the use of so-called "fold lines" or "crease lines" which, together with various cuts, punched out portions and support elements, define all of the components for forming the display stand 10. Throughout the discussion, for convenience and clarity, the components will be referred to by names which relate to their ultimate function in the erected display stand 10.

A base blank 40 of foldable sheet material from which a base 11 of the display stand 10 may be formed is shown in FIG. 2. The base blank 40 includes a centrally disposed bottom panel 41 having opposing left and right side-edges 42, 43 and opposing forward and rear edges 44, 45. Foldably connected to side-edges 42, 43 of bottom panel 41 are a pair of opposing side lip assemblies 38, 39. The side lip assemblies 38, 39 include outer panels 46, 47 foldably connected to side-edges 42, 43, respectively, of bottom panel 41, and inner panels 48, 49 foldably connected to outer panels 46, 47 at fold lines 50, 51, respectively. Outer panels 46, 47 have distal edges 52, 53, respectively, each distal edge 52, 53 having at least one securing tab 54 which engages with a corresponding slit 55 in the bottom panel 41 when the base 11 is assembled (as discussed more fully below), said slits being positioned proximate to said side edges.

Foldably connected to forward and rear edges 44, 45 of bottom panel 41 are opposing front lip and rear lip assemblies 62, 56, respectively. The rear lip assembly 56 comprises a rear lip panel 59 having opposing left and right fold lines 57, 58, said panel 59 being foldably connected to rear edge 45 of bottom panel 41. The rear lip assembly further comprises a pair of opposing flaps 60, 61 foldably connected to rear lip panel 59 at fold lines 57, 58, respectively.

Foldably connected to front edge 44 of bottom panel 41 is a front wall assembly 62 which includes a front lip panel 63 having opposing left and right fold lines 64, 65, an upper fold line 68 opposite front edge 44 of bottom panel 41, and a width w. Said panel 63 is foldably connected to front edge 44 of bottom panel 41. The front wall assembly 62 further includes a pair of opposing flaps 66, 67 foldably connected to front lip panel 63 at fold lines 64, 65, respectively. A step-top panel 69 having an inner fold line 70 opposite upper fold line 68 is foldably connected to upper fold line 68. A step-middle panel 71 having a lower fold line 72 opposite inner fold line 70 is foldably connected to inner fold line 70. A lower shelf panel 73 having a locking fold line 74 opposite lower fold line 72 is foldably connected to step-middle panel 71 at lower fold line 72. Finally, locking panel 75 having a distal edge 76 and a plurality of slots 77 perpendicularly located along said edge 76 is foldably connected to locking fold line 74.

Figure 4:
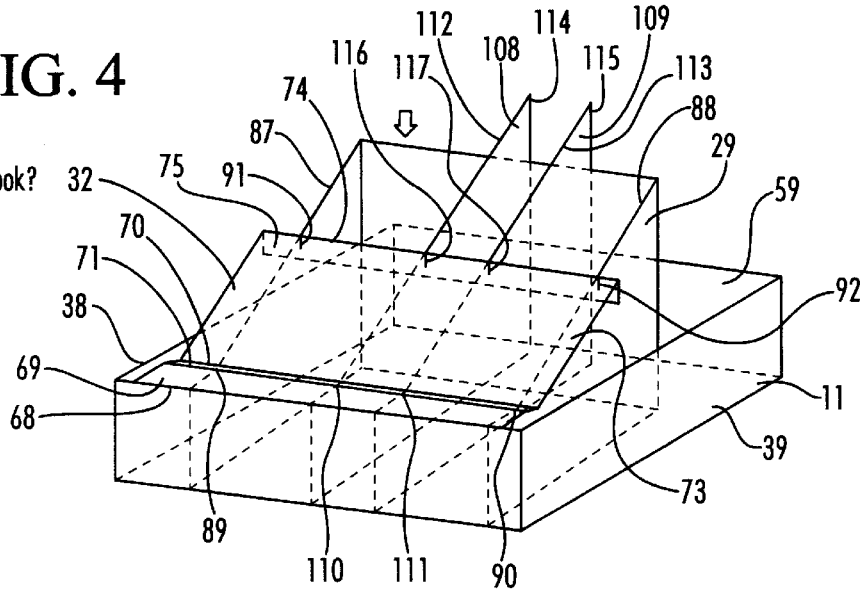
FIG. 4 is a perspective view of the insertion of the assembled lower support into the assembled base.

The base 11, shown in its assembled form in FIG. 4, is constructed from blank 41 by folding rear lip panel 59 and front lip panel 63 up at right angles to bottom panel 41 and flaps 60, 61, 66, 67 in at right angles to panels 59, 63, respectively. Left and right outer panels 46, 47 are then folded up at right angles to bottom panel 41 and left and right inner panels 48, 49 folder over flaps 60, 66 and 61, 67, respectively, until tabs 54 engage into corresponding slits 55 in bottom panel 41. Note that the width w of the front lip panel 63 of the base 11 is the height of the front lip panel 63 when the base 11 is assembled (as shown in FIG. 4).

FIG. 3*a* shows outer support blank 78, while FIG. 3*b* shows an inner support blank 79, both of foldable sheet material, from which a lower support 29 (shown assembled in FIG. 4) of the display stand 10 may be formed. The outer support blank 78 includes a centrally disposed front panel 80 having opposing left and right side-edges 81, 82 and a height h substantially the same as the width w of the front lip panel 63 of base blank 40 (shown in FIG. 2). The front panel 80 is sized laterally to fit loosely between the left and right side lip assemblies 38, 39 (as shown in FIG. 4). Foldably connected to side-edges 81, 82 of front panel 80 are a pair of opposing lateral side panels 83, 84 having a rear fold line 85, 86 opposite side-edge 81, 82, respectively, a step-template projection 89, 90 located proximate to side-edge 81, 82, respectively, a rearwardly inclining upper edge 87, 88, connecting step-template projection 89, 90 to rear fold line 85, 86, respectively, and a locking notch 91, 92 located along the upper edge 87, 88 proximate to rear fold line 85, 86.

Foldably connected to rear fold line 85, 86 are a pair of opposing rear support panels 93, 94, respectively, having a height y, an upper edge 95, 96, respectively, a rear edge 97, 98, respectively, and a pair of cooperating joining slots 99, 100 and 101, 102, respectively, located proximate to rear edges 97, 98 at a distance x apart.

The inner support blank 79 includes a centrally disposed front panel 105 having opposing left and right side-edges 106, 107, a height h' substantially the same as height h of the front panel 80 of blank 78, and a width x' substantially the same as the distance x between the pairs of joining slots 99, 100 and 101, 102 of rear support panels 93, 94, respectively. Foldably connected to side-edges 106, 107 of front panel 105 are a pair of opposing lateral side panels 108, 109 having a bottom edge 118, 119, a rear edge 114, 115 opposite each respective side-edge 106, 107 of front panel 80, a step-template projection 110, 111 located proximate to the associated side-edge 106, 107, a rearwardly inclining upper edge 112, 113 connecting step-template projection 110, 111 to rear edge 114, 115, respectively, a joining slot 120, 121 located along bottom edge 118, 119 proximate to rear edge 114, 115, respectively, and a locking notch 116, 117 located along the upper edge 112, 113 proximate to rear edge 114, 115, respectively. Note that the height y' of side panel 108, 109 at joining slot 120, 121 is substantially identical to the height y of rear support panels 93, 94 of blank 78.

The lower support 29 is constructed from blanks 78 and 79 by folding blank 78 along its various fold lines 81, 82, 85, 86 into a rectangular sleeve such that joining slots 99 and 100 of rear support panel 93 aline with joining slots 101 and 102, respectively, of rear support panel 94. Joining slot 120 of side panel 108 is then connected with joining slots 100 and 102 while, simultaneously, joining slot 121 of side panel 109 is connected to joining slots 99 and 101 such that front panel 105 of inner support blank 79 contacts front panel 80 of outer support blank 78. When joined in this configuration, step-template projections 89, 110, 111, 90 align as do locking notches 91, 116, 117, 92. Similarly, the upper edges 87, 112, 113, 88 of side panels 83, 108, 109, 84, respectively, and upper edges 95, 96 of rear support panels 93, 94 all lie in the same plane.

Lower support 29 is preferably pre-assembled prior to shipping to the point of use, and, to that end, is collapsible along its various fold lines into a substantially flat unit for shipping.

As shown in FIG. 4, the next step in the assembly of the display stand 10 is the insertion of lower support 29 into base 11. Lower support 29 is sized to fit relatively snugly within the base 11 from rear to front, leaving just sufficient room for rear wall 20 (shown in FIG. 1) of the stand 10 to fit between the rear edges 114, 115 of side panels 108, 109 and the rear lip panel 59 of base 11, but does not contact the side lip assemblies 38, 39 of the base 11. Step-top panel 69 and stop-middle panel 71 are then folded along upper fold line 68 and inner fold line 70 over the aligned step-template projections 89, 110, 111, 90. In this configuration, lower shelf panel 73 rests atop upper edges 87, 112, 113, 88 with locking fold line 74 aligned with the aligned locking notches 91, 116, 117, 92. Locking panel 75 is then folded downward into locking notches 91, 116, 117, 92 with the strategically placed slots 77 (not shown) interlocking with a corresponding locking notch 91, 116, 117, 92, thereby securing base 11 and lower support 29 together into a single unit and forming shelf 32.

Figure 5:
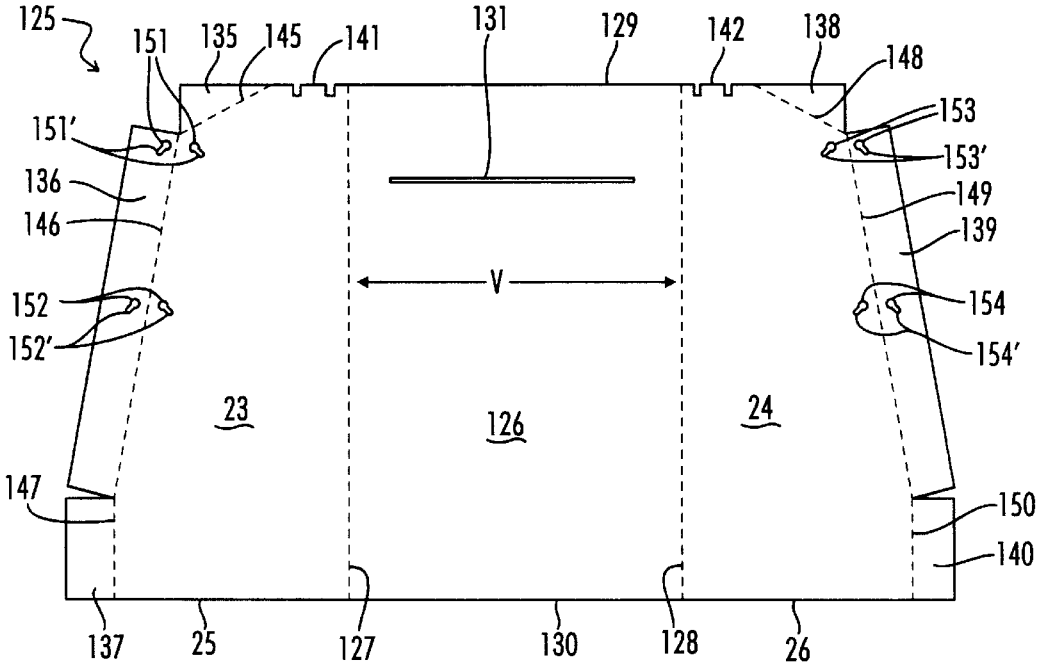
FIG. 5 is a plan view of a wall blank of foldable sheet material from which the rear wall and side wall assemblies of the display stand may be formed.

Turning then to FIG. 5, a wall blank 125 of foldable sheet material from which the rear wall 20 and side wall assemblies 25, 26 of the display stand 10 may be formed is shown. The wall blank 125 includes a centrally disposed rear wall panel 126 having a width v, opposing left and right side-edges 127, 128, opposing upper and lower edges 129, 130, and a means for supporting the rear end 167 of a medial shelf 31 (shown in FIGS. 1 and 6) such as slot 131. Foldably connected to side-edges 127, 128 of rear wall panel 126 are a pair of symmetrical opposing side wall assemblies 25, 26. The side wall assemblies 25, 26 include a side wall panel 23, 24, at least one reinforcing flap and associated fold line, such as reinforcing flaps 135, 136, 137 and 138, 139, 140, respectively, and fold lines 145, 146, 147 and 148, 149, 150, respectively, and a side wall connecting means, such as recessed tongue 141, 142. A plurality of paired, cooperating openings 151, 152, 153, 154 having a securing means such as notches 151', 152', 153' and 154', are positioned on opposite sides of fold line 146, 149.

Side assemblies 25, 26 are preferably preassembled at the point of manufacture, such assembly comprising folding reinforcing flaps 135, 136, 137, 138, 139, 140 inward along their respective fold lines 145, 146, 147, 148, 149, 150 and joining said flaps to the respective side wall panel 23, 24 by a suitable retainer (not shown), such as any of the adhesives commonly employed for use in connection with corrugated board, or staples. These reinforcing flaps 135, 136, 137, 138, 139, 140 are largely structural elements which add strength to the display stand 10, though the folded paperboard also presents a more finished look to the open front 12 (shown in FIG. 1) of the display stand 10 than would the unfinished edges (not shown) of the side wall panels 23, 24. Fold lines 145, 146, 148, 149 may be rearwardly inclined relative to left and right side-edges 127, 128 in order to display the products more openly to potential consumers (as shown in FIG. 1).

Figure 6:
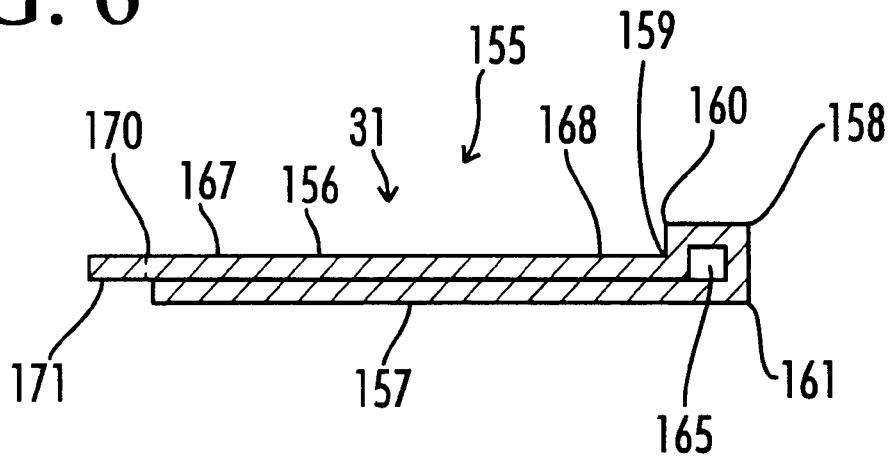
FIG. 6 is a cross-sectional view of a medial shelf blank from which a medial shelf of the display stand is formed.

FIG. 6 shows a cross-sectional view of a medial shelf blank 155 folded so as to form a medial shelf 31 of the display stand 10. The medial shelf 31 has an rear end 167 and a front end 168 and a width parallel to ends 167 and 168 substantially the same as the width v of the rear wall panel 20 (shown in FIG. 5). The medial shelf blank 155 includes rectangular top and bottom shelf panels 156, 157, respectively, foldably connected at center fold line 158. Top shelf panel 156 also has a flap fold line 170 opposite center fold line 158 proximate to the rear end 167 of the shelf 31. Foldably connected to top shelf panel 156 at fold line 170 is a flap 171. Sleeve fold lines 159, 160 are disposed across top shelf panel 156 parallel to center fold line 158 proximate to center fold line 158. Bottom shelf panel 157 also has a laterally disposed sleeve fold line 161 parallel to center fold line 158 positioned proximate to center fold line 158.

Figure 8:
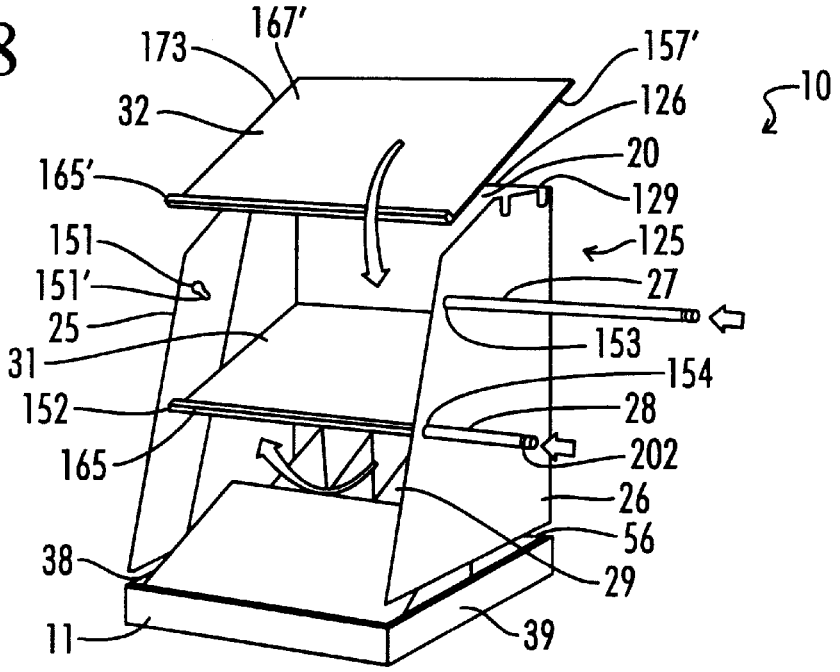
FIGS. 8 and 9 are perspective views of the final assembly of the display stand of the present invention.

Medial shelf 31 is formed by adhesively joining top shelf panel 156 of blank 155 atop bottom shelf panel 157, with care being taken that no adhesive joins top and bottom shelf panels 156, 157 between fold lines 159 and 161 and center fold line 156. Thus it can be seen that a flexible sleeve 165 is created at the front end 168 of the shelf 31 as shown in FIG. 6. As shown in FIG. 8, the medial shelf 31 is flexibly affixed to rear wall panel 126 by inserting flap 171 through slot 131, folding it downward against panel 126 and joining the flap 171 to the rear wall panel 126 with a suitable retainer, such as adhesive.

As with lower support 2, the medial shelf 31 is preferably pre-assembled from blank 155 and affixed to rear wall panel 126 at the point of manufacture. Because the medial shelf 31 is flexibly affixed to rear wall panel 126 and because the sleeve 165 is also flexibly formed, the pre-assembly of wall blank 125 and media shelf 31 does not prevent these components, once assembled, from being shipped as a single flat component.

The present invention further comprises an upper shelf blank 173 from which an upper shelf 32 (shown in FIGS. 8 and 9) may be formed. Upper shelf blank 173 is identical in all respects to medial shelf blank 155 except for the absence of a flap, such as flap 171 of medial shelf blank 155. Where necessary, individual features of upper shelf blank 173 will be identified in the drawings and text by the prime of the corresponding feature of the medial shelf blank 155. For example, the rear end of the upper shelf would be denoted 167'. Upper shelf 32 is also pre-assembled at the point of manufacture prior to shipping, though it is not affixed to any other component of the display stand until final assembly as described in more detail below.

Figure 7:
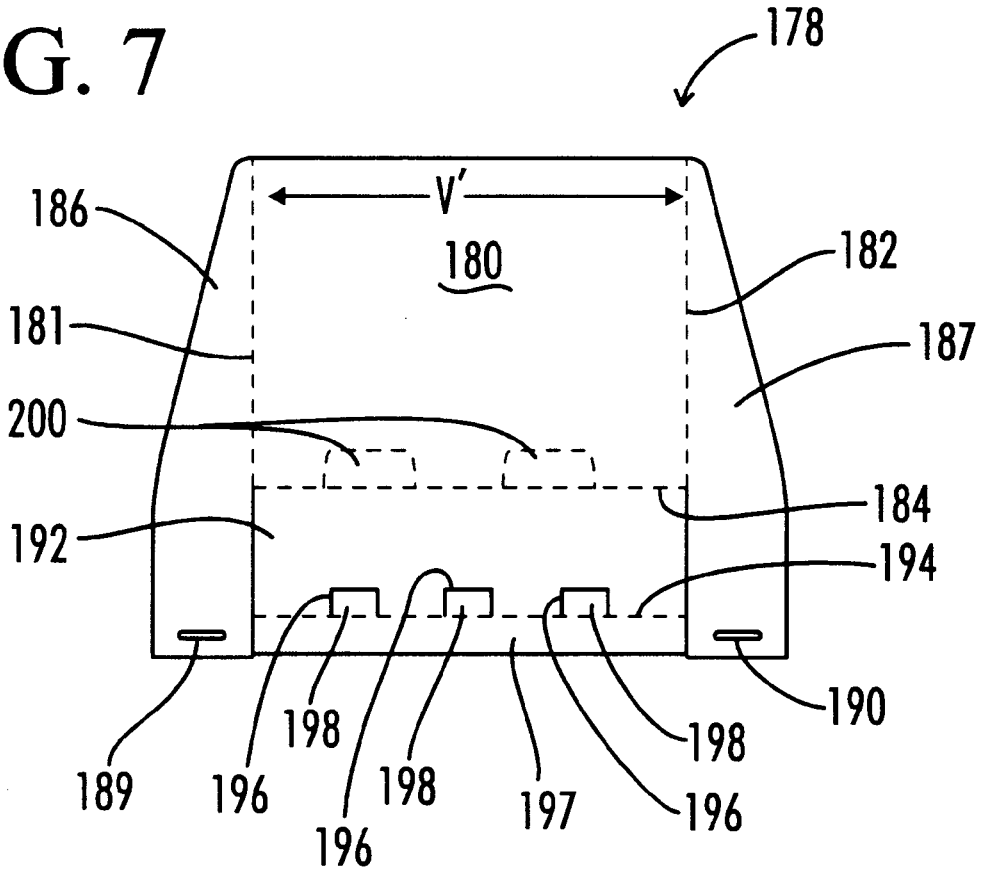
FIG. 7 is a plan view of a header blank of foldable sheet material from which a header for the display stand may be formed.

Turning then to FIG. 7, a header may be formed as from header blank 178 of foldable sheet material. The resulting header device 15 is appropriate for supporting graphic materials. The header blank 178 includes a centrally disposed display panel 180 having opposing left and right side-edges 181, 182, a lower edge 184, and a width v' substantially the same as the width v of the rear wall panel 20 (shown in FIG. 5). The display panel 180 contains a plurality of access panels 200 which are preferably positioned proximate to lower edge 184. The access panels 200 are made as parts of the paperboard panel 180 and are initially perforated at the edges by appropriate die cutting to facilitate later tear-out removal. Foldably connected to side-edges 181, 182 of display panel 180 are a pair of opposing side upright panels 186, 187, respectively, each having a header connecting means, such as slot 189, 190.

Foldably connected to lower edge 184 of display panel 180 is packaging shelf panel 192, having a lower fold line 194 opposite lower edge 184. Foldably connected to lower fold line 194 is a blocker panel 197. A plurality of cuts, such as cuts 196, coterminously abut lower fold line 194. Such cuts define a like number of projections 198 of blocker panel 197 which, when blocker panel 197 is folded at any angle relative to shelf panel 192 along fold line 194, extend above (or below as the case may be) the plane of shelf panel 192.

Figure 9:
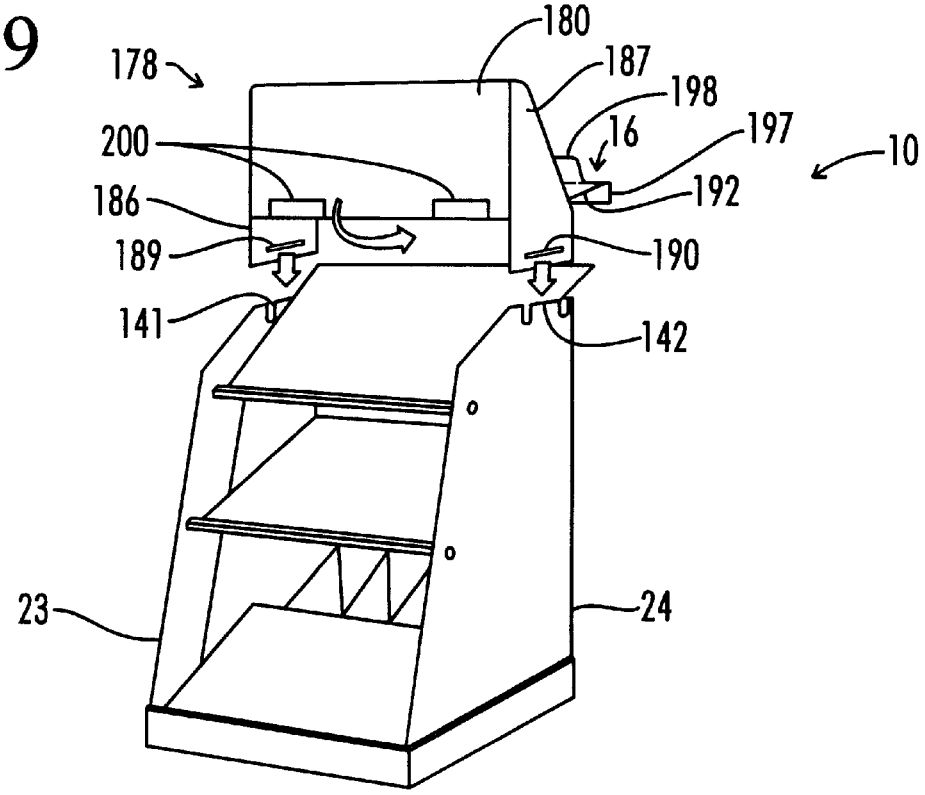

The final assembly of the display stand 10 of the present invention is shown in FIGS. 8 and 9. As shown in FIG. 8, side wall assemblies 25, 26 of wall blank 125 are folded forward at right angles to rear wall panel 126 and medial shelf 31 pulled upward so that the opened sleeve 165 aligns with openings 152 and 154. A support member having releasable securing means, such as dowel 28 with grooves 202 positioned proximate each end, is then inserted through openings 154, 152 and sleeve 165, and secured therein with the securing means, such as by pushing grooves 202 into receiving notches 154', 152' (not shown in FIG. 8) of openings 154, 152.

Wall blank 125 is then inserted into base 11 such that it surrounds lower support 29, the rear wall 20 and side wall assemblies 25, 26 being supported inside the lip assemblies 38, 39 and 56 of the base 11. Upper shelf 32 is next securely joined to side wall assemblies 25, 26 by inserting supporting member 27 through openings 151, 153 and sleeve 165' of shelf 32, then pushing grooves 203 into receiving notches 151', 153' (notch 153' is not shown in FIG. 8) of openings 151, 153. The bottom shelf panel 157' of upper shelf 32 rests atop the upper edge 129 of rear wall panel 126.

As shown in FIG. 9, header blank 178 is attached to the display stand by folding upright panels 186, 187 back, folding packaging shelf panel 192 under, then affixing the upright panels 186, 187 to side walls 23, 24, respectively, by connecting means, such as inserting tongues 141 and 142 into slots 189 and 190, respectively. In this configuration, with blocker panel 197 folded down, packaging shelf panel 192 forms container shelf 16. Access panels 200 may then be removed and additional packaging (not shown) accessibly placed upon container shelf 16 and held in place by the projections 198 of blocker panel 197.

As shown in FIG. 1, a plurality of individual boxes 14 containing product 13 such as multiple types of individually wrapped candies are then placed upon the shelves 30, 31 and 32 of the display stand 10 for display. An individual box 14 containing individually wrapped candies typically weighs on the order of 28 to 30 pounds. When the display stand 10 of the present invention is constructed from standard weight paperboard and wooden dowels 27, 28, each shelf 30, 31 and 32 of the present invention is capable of supporting two of the individual boxes 14, or approximately 60 pounds.

Consumers may then select desired types and quantities of the products and package their assortment in the readily available packaging stored upon container shelf 16. The inclination of the boxes 14 on the shelves 30, 31, 32 promotes the gravity feed of the individually wrapped product 13 within the boxes 14 to the front edge for easy accessibility. The inclination of the shelves 30, 31, 32 also vectors the force from the weight of the boxes 14 towards the associated supporting member 27, 28, 29, thereby relieving the gravitational stresses applied to the paperboard material of the shelves 30, 31, 32.

Appropriate advertising literature as may be suitable for use with the products displayed in the stand 10 may be prominently featured upon the display panel 180, as well as upon the walls 20, 25, 26 of the stand 10.

While several embodiments of the present invention have been disclosed, it is to be understood by those skilled in the art that other forms can be adopted, all coming within the spirit of the invention and scope of the appended claims:

We claim:

1. A multiple product display stand comprising:

(a) a base formed from foldable sheet material, said base comprising:

(i) a centrally disposed bottom panel having opposing left and right side-edges, opposing forward and rear edges, and at least one slit positioned proximate to each respective left and right side-edge;

(ii) a pair of opposing side lip assemblies foldably connected to the left and right side-edges, each opposing side lip assembly further comprising (1) an inner panel foldably connected to the bottom panel at a side-edge and having a fold line opposite the side-edge, (2) an outer panel foldably connected to the inner panel at the fold line and having a distal edge, said distal edge having at least one securing tab sized to engage with the corresponding slit proximate to the side-edge in the bottom panel;

(iii) a front lip assembly foldably connected to the forward edge, said front lip assembly further comprising (1) a front lip panel having opposing left and right fold lines, an upper fold line opposite the front edge of the bottom panel, and a pair of opposing flaps foldably connected to the front lip panel at the left and right fold lines, (2) a step-top panel foldably connected to the front lip panel at the upper fold line and having an inner fold line opposite the upper fold line, (3) a step-middle panel foldably connected to the step-top panel at the inner fold line and having a lower fold line opposite the inner fold line, (4) a lower shelf panel foldably connected to the step-middle panel at the lower fold line and having a locking fold line opposite the lower fold line, and (5) a locking panel foldably connected to the lower shelf panel at the locking fold line and having a distal edge and a plurality of slots located along the distal edge; and (iv) a rear lip assembly foldably connected to the rear edge, said rear lip assembly further comprising a rear lip panel foldably connected to the bottom panel at the rear edge and having opposing left and right fold lines and a pair of opposing flaps foldably connected to the rear lip panel at the left and right fold lines;

(b) a central, vertically disposed rear wall panel formed from foldable sheet material and having:

(i) opposing left and right side-edges;

(ii) opposing upper and lower edges;

(iii) a means for supporting the rear end of a shelf; and (iv) a pair of opposing side wall assemblies foldably connected to the rear wall panel at the left and right side-edges, each opposing side wall assembly further comprising (1) a side wall connecting means, and (2) a side wall panel foldably connected to the rear wall panel at a side-edge and having at least one reinforcing flap foldably connected to the side wall panel at an associated fold line, said side wall panel and reinforcing flap having paired, cooperating openings with securing means, said rear wall and opposing side wall assemblies being supported inside the lip assemblies of the base;

(c) a vertically spaced, rearwardly inclined shelf formed from foldable sheet material having opposing front and rear ends, the front end supported between said side wall assemblies by a support member engaging said paired, cooperating openings in each of said opposing side wall assemblies, and the rear end supported by said means for supporting the rear end of a shelf; and (d) a header, said header formed from foldable sheet material attached to the side wall assemblies and having:

(i) a centrally disposed display panel having opposing left and right side-edges;

(ii) a lower edge;

(iii) a plurality of access panels;

(iv) a packaging shelf panel foldably connected to the display panel at the lower edge and being rearwardly disposed from the lower edge of the display panel; and (v) a pair of opposing side upright panels foldably connected to the display panel at the left and right side-edges, said side upright panels having header connecting means for attachment to the side wall connecting means.

2. The multiple product display stand of claim 1 wherein the shelf further comprises an upper shelf, a medial shelf, and a lower shelf, and wherein the means for supporting the rear end of the upper shelf comprises the upper edge of the rear wall panel, the means for supporting the rear end of the medial shelf comprises a flap foldably connected to the rear end of the medial shelf, said flap being inserted through a slot in the rear wall panel and adhesively joined to the rear wall panel, and wherein the means for supporting the rear end of the lower shelf comprises a lower support member formed from foldable sheet material, said lower support member being inserted into the base.

3. The multiple product display stand of claim 2 wherein each support member for the front end of the upper and medial shelves further comprises a dowel having a pair of opposing ends and releasable securing means positioned proximate each end, said dowel being secured between said side wall assemblies through a flexible sleeve at the front end of each shelf.

4. The multiple product display stand of claim 3 wherein the releasable securing means comprises a groove.

5. The multiple product display stand of claim 1 wherein the reinforcing flap is adhesively joined to the side wall panel by a suitable retainer.

6. The multiple product display stand of claim 1 wherein the means for supporting the rear end a shelf comprises a lower support member formed from foldable sheet material inserted into the base, said lower support member further comprising:

(a) an outer support blank, said outer support blank further comprising:
  (i) a centrally disposed front panel having opposing left and right side-edges; and
  (ii) a pair of opposing lateral side panels foldably connected to left and right side-edges, each of the lateral side panels having (1) a rear fold line opposite the side-edge, (2) a step-template projection located proximate to the side-edge, (3) a rearwardly inclining upper edge connecting the step-template projection to the rear fold line, (4) a locking notch located along the upper edge proximate to the rear fold line, and (5) a rear support panel foldably connected to rear fold line and having an upper edge, a rear edge and a pair of joining slots located along the upper edge proximate to the rear edge; and (b) an inner support blank, said inner support blank further comprising:
  (i) a centrally disposed front panel having opposing left and right side-edges; and
  (ii) a pair of opposing lateral side panels foldably connected to left and right side-edges, each of the lateral side panels having (1) a bottom edge, (2) a rear edge opposite each respective side-edge of the front panel, (3) a step-template projection located proximate to the associated side-edge of the front panel, (4) a rearwardly inclining upper edge connecting the step-template projection to the rear edge, (5) a joining slot located along the bottom edge proximate to the rear edge, and (6) a locking notch located along the upper edge proximate to the rear edge;

said inner support blank being connected to the outer support blank by the aligned connection of the joining slots of the inner support blank with the paired joining slots of the rear support panel of the outer support blank.

7. The multiple product display stand of claim 1 wherein the support member for the front end of the shelf comprises a dowel having a pair of opposing ends and releasable securing means positioned proximate each end, said dowel being secured between said side wall assemblies through a flexible sleeve at the front end of the shelf.

8. The multiple product display stand of claim 7 wherein the releasable securing means comprises a groove.

9. A multiple product display stand comprising:

(a) a base formed from foldable sheet material, said base comprising:
  (i) a centrally disposed bottom panel;
  (ii) a pair of opposing side lip assemblies foldably connected to said bottom panel;
  (iii) a front lip assembly foldably connected to said bottom panel, said front lip assembly further comprising (1) a front lip panel having an upper fold line opposite the bottom panel, (2) a step-top panel foldably connected to the front lip panel at the upper fold line and having an inner fold line opposite the upper fold line, (3) a step-middle panel foldably connected to the step-top panel at the inner fold line and having a lower fold line opposite the inner fold line, (4) a lower shelf panel foldably connected to the step-middle panel at the lower fold line and having a locking fold line opposite the lower fold line, and (5) a locking panel foldably connected to the lower shelf panel at the locking fold line and having a distal edge and a plurality of slots located along the distal edge; and
  (iv) a rear lip assembly foldably connected to said bottom panel;

(b) a central, vertically disposed rear wall panel formed from foldable sheet material and having a means for supporting the rear end of a shelf, and a pair of opposing side wall assemblies foldably connected to the rear wall panel, each opposing side wall assembly having a side wall connecting means and paired, cooperating openings with securing means, said rear wall and opposing side wall assemblies being supported inside the lip assemblies of the base;

(c) a vertically spaced, rearwardly inclined shelf formed from foldable sheet material having opposing front and rear ends, the front end supported between said side wall assemblies by a support member engaging said paired, cooperating openings in each of said side wall assemblies, and the rear end supported by means for supporting the rear end of a shelf; and (d) a header, said header formed from foldable sheet material attached to the side wall assemblies and having a centrally disposed display panel having a plurality of access panels, and a packaging shelf panel foldably connected to the display panel and being rearwardly disposed from the display panel.

10. The multiple product display stand of claim 9 wherein the shelf further comprises an upper shelf, a medial shelf, and a lower shelf, and wherein the means for supporting the rear end of the upper shelf comprises an upper side of the rear wall panel, the means for supporting the rear end of the medial shelf comprises a flap foldably connected to the rear end of the medial shelf, said flap being inserted through a slot in the rear wall panel and adhesively joined to the rear wall panel, and wherein the means for supporting the rear end of the lower shelf comprises a lower support member formed from foldable sheet material, said lower support member being inserted into the base.

11. The multiple product display stand of claim 10 wherein each support member for the front end of the upper and medial shelves further comprises a dowel having a pair of opposing ends and releasable securing means positioned proximate each end, said dowel being secured between said side wall assemblies through a flexible sleeve at the front end of each shelf.

12. The multiple product display stand of claim 11 wherein the releasable securing means comprises a groove.

13. The multiple product display stand of claim 9 wherein the means for supporting the rear end of a shelf comprises a lower support member formed from foldable sheet material inserted into the base, said lower support member further comprising:

(a) an outer support blank, said outer support blank further comprising:

(i) a centrally disposed front panel having opposing left and right side-edges; and (ii) a pair of opposing lateral side panels foldably connected to left and right side-edges, each of the lateral side panels having (1) a rear fold line opposite the side-edge, (2) a step-template projection located proximate to the side-edge, (3) a rearwardly inclining upper edge connecting the step-template projection to the rear fold line, (4) a locking notch located along the upper edge proximate to the rear fold line, and (5) a rear support panel foldably connected to rear fold line and having an upper edge, a rear edge and a pair of joining slots located along the upper edge proximate to the rear edge; and (b) an inner support blank, said inner support blank further comprising:

(i) a centrally disposed front panel having opposing left and right side-edges; and (ii) a pair of opposing lateral side panels foldably connected to left and right side-edges, each of the lateral side panels having (1) a bottom edge, (2) a rear edge opposite each respective side-edge of the front panel, (3) a step-template projection located proximate to the associated side-edge of the front panel, (4) a rearwardly inclining upper edge connecting the step-template projection to the rear edge, (5) a joining slot located along the bottom edge proximate to the rear edge, and (6) a locking notch located along the upper edge proximate to the rear edge;

said inner support blank being connected to the outer support blank by the aligned connection of the joining slots of the inner support blank with the paired joining slots of the rear support panel of the outer support blank.

14. The multiple product display stand of claim 9 wherein the support member for the front end of the shelf comprises a dowel having a pair of opposing ends and releasable securing means positioned proximate each end, each said dowel being secured between said side wall assemblies through a flexible sleeve at the front end of the shelf.

15. The multiple product display stand of claim 14 wherein the releasable securing means comprises a groove.

* * * * *